US009564721B2

(12) United States Patent
Yu et al.

(10) Patent No.: US 9,564,721 B2
(45) Date of Patent: Feb. 7, 2017

(54) TERMINAL ASSEMBLY HAVING A SHIELDING PART WITH ELASTIC ARMS

(71) Applicant: Tyco Electronics (Shanghai) Co. Ltd., Shanghai (CN)

(72) Inventors: Zengliang Yu, Shanghai (CN); Chengzan Wang, Shanghai (CN); Xuexiu Li, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/007,100

(22) Filed: Jan. 26, 2016

(65) Prior Publication Data

US 2016/0218470 A1 Jul. 28, 2016

(30) Foreign Application Priority Data

Jan. 28, 2015 (CN) ..... 2015 2 0060877

(51) Int. Cl.
*H01R 9/05* (2006.01)
*H01R 24/38* (2011.01)
(Continued)

(52) U.S. Cl.
CPC ..... *H01R 24/38* (2013.01); *H01R 4/28* (2013.01); *H01R 9/0512* (2013.01);
(Continued)

(58) Field of Classification Search
CPC ..... H01R 9/05; H01R 9/0512; H01R 9/0517; H01R 9/0518; H01R 13/648; H01R 13/65802
(Continued)

(56) References Cited

U.S. PATENT DOCUMENTS 7,632,143 B1 12/2009 Islam
9,099,825 B2 * 8/2015 Wild ..... H01R 24/38
(Continued)

FOREIGN PATENT DOCUMENTS

EP 2579395 4/2014

OTHER PUBLICATIONS

European Search Report issued by the European Patent Office, dated Jun. 1, 2016, for related European Patent Application No. 16153251.0; 7 pages.

*Primary Examiner* — Chandrika Prasad
(74) *Attorney, Agent, or Firm* — Faegre Baker Daniels LLP

(57) ABSTRACT

The present invention discloses a terminal assembly with a cable and a connector assembly. The terminal assembly with the cable of the present invention has a terminal assembly including a connecting terminal, a shielding shell and an insulator arranged between the connecting terminal and the shielding shell; and a cable including a shielding layer. One portion of the shielding shell in the terminal assembly and one portion of the shielding layer in the cable form a mutual overlapping region along the radial direction of the cable. In the mutual overlapping region, the shielding layer is electrically connected with the shielding shell. The terminal assembly of the present invention is applicable to automobiles as a high-voltage connector. In its use in an automobile, the terminal assembly is capable of effectively resisting shock and preventing mechanical vibration from causing separation of the connector to affect safe use.

14 Claims, 7 Drawing Sheets

(51) Int. Cl.

| | |
|---|---|
| ***H01R 13/6592*** | (2011.01) |
| ***H01R 4/28*** | (2006.01) |
| *H01R 13/506* | (2006.01) |
| *H01R 13/6582* | (2011.01) |
| *H01R 101/00* | (2006.01) |

(52) U.S. Cl.
CPC ..... *H01R 9/0527* (2013.01); *H01R 13/6592* (2013.01); *H01R 13/506* (2013.01); *H01R 13/6582* (2013.01); *H01R 2101/00* (2013.01)

(58) Field of Classification Search
USPC ..... 439/578, 584, 585, 607.01
See application file for complete search history.

(56) References Cited

U.S. PATENT DOCUMENTS

| | | | | |
|---|---|---|---|---|
| 9,287,659 | B2 * | 3/2016 | Burris | H01R 9/0524 |
| 2005/0118865 | A1 * | 6/2005 | Henningsen | H01R 9/0524 439/578 |
| 2007/0149047 | A1 * | 6/2007 | Wild | H01R 9/0521 439/578 |
| 2009/0053931 | A1 * | 2/2009 | Islam | H01R 9/05 439/578 |
| 2009/0221181 | A1 * | 9/2009 | Langhoff | H01R 13/03 439/607.02 |
| 2010/0221949 | A1 * | 9/2010 | Okamoto | H01R 4/184 439/585 |
| 2014/0213089 | A1 * | 7/2014 | Ueberschlag | H01R 13/562 439/271 |

* cited by examiner

TERMINAL ASSEMBLY HAVING A SHIELDING PART WITH ELASTIC ARMS

CLAIM OF PRIORITY

The present application claims priority from Chinese patent application CN 201520060877.X filed Jan. 28, 2015; the subject matter of which is incorporated herein by reference.

FIELD OF THE INVENTION

The present invention relates to a terminal assembly with a cable and a connector assembly.

BACKGROUND OF THE INVENTION

In certain use occasions, such as high voltage applications, a terminal or connector is generally provided with a shielding shell and a cable core of a cable connected with a terminal is covered with a shielding layer. In actual use, a shielding function can be achieved only after an effective electric connection is realized between the shielding layer of the cable and the shielding shell of the terminal or connector. A common connection between the shielding shell and the shielding layer is a compression connection. If the compression connection is adopted, a shielding sleeve and a shielding bushing are further required to realize switchover.

FIG. 1 shows a principle diagram of a shielded connection between a connector and a cable. A connecting terminal 11 is connected with a cable core 13 of a cable 12. One end of a shielding sleeve 14 is connected with a shielding shell (not shown in the figure), while the other end thereof is connected via compression with a shielding layer 15 of the cable 12 through a shielding bushing 16.

During compressing, an end of the shielding sleeve 14 is sleeved on the shielding layer 15 of the cable 12 to form an overlapping region. One end (e.g., left end as shown in FIG. 1) of the shielding bushing 16 is sleeved outside the overlapping region formed by the end of the shielding sleeve 14 and the shielding layer 15 of the cable 12. The shielding bushing 16 is pressed to deform by use of a special crimping tool, and the deformed shielding bushing 16 tightly compresses the shielding sleeve 14 and the shielding layer 15 to realize an effective shielded connection between the shielding shell and the shielding layer 15 of the cable. The other end (e.g., right end as shown in FIG. 1) of the shielding bushing 16 is sleeved on an end of the cable 12 and is connected via compression with the same so that the shielding bushing 16 is mechanically connected with the cable 12.

In such a connection design, two connecting components, namely the shielding bushing 16 and the shielding sleeve 14, are required, and a corresponding compression tool is required to be developed; besides, a corresponding workstation design is also required for assembling the product. However, such a connection design is not only complex in structure and high in manufacturing cost, but also troublesome in assembling and high in difficulty.

SUMMARY OF THE INVENTION

An object of the present invention is to provide a simply structured terminal assembly with a cable in order to overcome the shortcomings of the prior art. To achieve the object, the present invention is implemented through the following technical solution:

A terminal assembly with a cable comprises: a terminal assembly, comprising a connecting terminal, a shielding shell and an insulator arranged between the connecting terminal and the shielding shell; a cable comprising a shielding layer; and characterized in that a portion of the shielding shell of the terminal assembly and a portion of the shielding layer of the cable are formed into a mutual overlapping region along the radial direction of the cable; and wherein in the mutual overlapping region, the shielding layer is electrically connected with the shielding shell.

Preferably, the shielding shell is provided with a second receiving cavity and a second inserting hole, and the second receiving cavity is communicated with the second inserting hole; the insulator is provided with a sleeve having a third inserting hole; and after the insulator is mounted in the second receiving cavity of the shielding shell, the sleeve on the insulator projects out of the second receiving cavity from the second inserting hole.

Preferably, the portion of the shielding shell comprises a shielding connecting part arranged around the second inserting hole.

Preferably, the shielding layer is provided with a shielding collar, the shielding connecting part is sleeved on the outer surface of the sleeve and the shielding collar surrounds the shielding connecting part and is sleeved outside the shielding connecting part; and the shielding connecting part is located between the sleeve and the shielding collar; and the shielding collar is in contact with the shielding connecting part.

Preferably, the shielding connecting part comprises a plurality of elastic arms arranged around the second inserting hole and the plurality of elastic arms are located between the sleeve and the shielding collar.

Preferably, the terminal assembly with the cable further comprises a compress ring, wherein the portion of the shielding layer surrounds the shielding connecting part; and the portion of the shielding layer of the cable is located between the plurality of elastic arms and the compress ring along the radial direction of the cable.

Preferably, the terminal assembly with the cable further comprises a compress ring, wherein the compress ring is sleeved over the overlapping region so that the portion of the shielding shell and the portion of the shielding layer are kept in contact with each other in the overlapping region to realize the electric connection of the shielding shell with the shielding layer.

Preferably, the terminal assembly with the cable is a manually assembled assembly.

Another object of the present invention is to provide a simply structured terminal assembly with a cable in order to overcome the shortcomings of the prior art. To achieve the object, the present invention is implemented through the following technical solution:

A connector assembly, characterized by comprising a connector housing and the terminal assembly with the cable of any one of claims 1-8, wherein the connector housing is provided with a first receiving cavity and a first inserting hole, and the first inserting hole is communicated with the first receiving cavity; and wherein the terminal assembly is arranged in the first receiving cavity while the cable is led out of the housing via the first inserting hole.

Preferably, the connector assembly further comprises a sealing element sleeved outside the cable and is arranged in the first inserting hole of the connector housing or at an end of the connector housing to seal the terminal assembly in the first receiving cavity.

Preferably, the connector assembly further comprises a retaining mechanism for fixing the sealing element at the end of the connector housing or in the first inserting hole.

Preferably, the connector assembly further comprises a sealing ring retainer, wherein one end of the sealing ring retainer is sleeved on an end of the connector housing and is detachably fixed to the connector housing.

Preferably, the connector assembly further comprises a hoop sleeved on the other end of the sealing ring retainer to fix the sealing ring retainer on the cable.

Preferably, the other end of the sealing ring retainer is of a splitted structure to form a plurality of elastic pieces that are spaced from each other; and wherein the hoop is sleeved on the plurality of elastic pieces and is in tight fit with the plurality of elastic pieces to deform the elastic pieces to produce elastic force.

Preferably, each of the elastic pieces is provided with a length of groove, the grooves on the plurality of elastic pieces are continuously arranged to form a circle of grooves; and wherein the hoop is located in the grooves.

Preferably, a flange is formed at an end of each elastic piece, and the flanges project from the outer walls of the elastic pieces to prevent the hoop from falling off from the elastic pieces.

According to the terminal assembly with the cable and the connector assembly in the present invention, the shielding layer of the cable can be put into a contact connection with the elastic arms of the shielding shell in the terminal assembly by pushing the shielding collar, thereby realizing the electric connection between the shielding shell in the terminal assembly and the shielding layer of the cable. Such a connection way of the elastic arms of the shielding shell of the terminal assembly and the shielding layer of the cable does not require crimping, and therefore, the assembling difficulty is reduced and small force is required. No special tool is needed for mounting the shielding collar and the hoop to realize easy and convenient assemblies. In the present invention, the shielding collar is utilized instead of the shielding sleeve and the shielding bushing, and therefore, the connector is simpler in structure, and furthermore, the production cost is reduced and the structure is more compact so that the size of the connector in the axial direction of the cable can be effectively reduced. As the clamping grooves or the flanges are formed on the sealing ring retainer, the sealing ring retainer can be tightly sleeved on the cable firmly by use of the hoop so that the sealing element is retained in the housing, and the cable and the shell are fixed together to achieve higher safety and reliability in use. Furthermore, the terminal assembly with the cable of the present invention thus is applicable to automobiles as a high-voltage connector. During its use in an automobile, the terminal assembly with the cable is capable of effectively resisting shock and preventing mechanical vibration from causing separation of the connector to affect safe use.

BRIEF DESCRIPTION OF THE DRAWINGS

The following description is set forth in connection with the attached drawing figures, which are not necessarily to scale, emphasis instead generally being placed upon illustrating the principles of the invention. In the drawing figures.

DETAILED DESCRIPTION OF THE EMBODIMENTS

Figure 1:
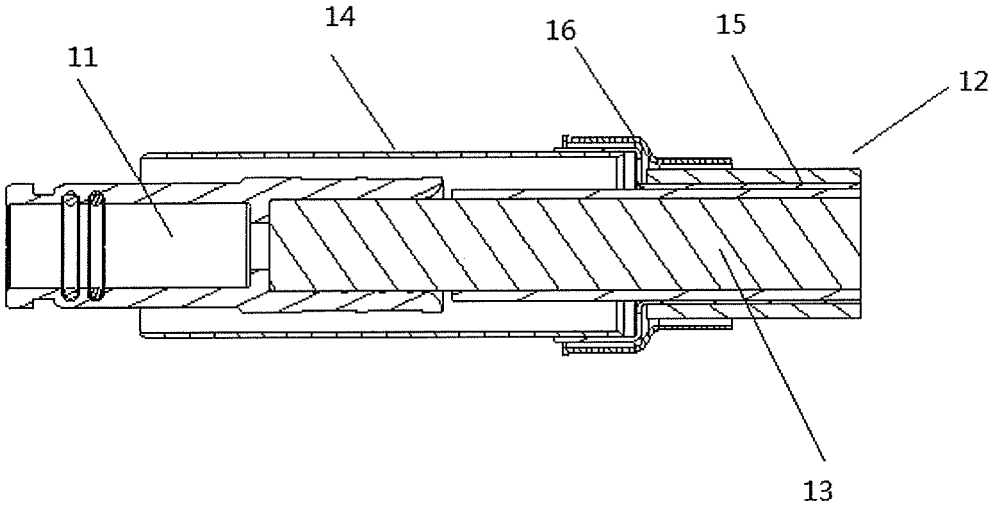
FIG. 1 is a principle diagram of shielded connection between a connector and a cable.
Figure 2:
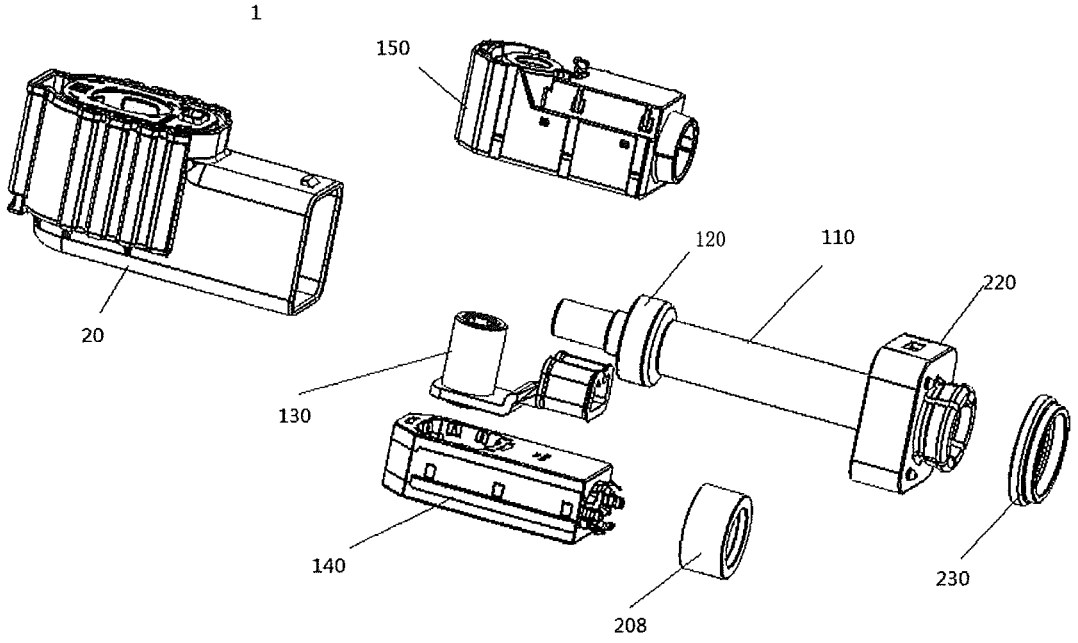
FIG. 2 is an exploded structural view showing a connector assembly in the invention.
Figure 3:
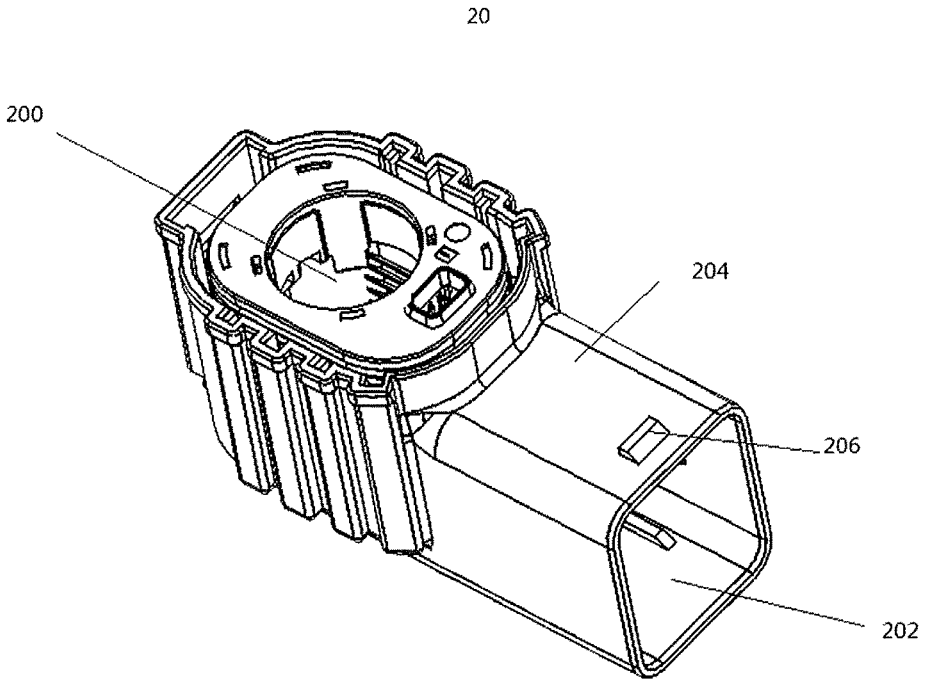
FIG. 3 is a structural schematic diagram showing a connector housing in the invention.
Figure 11:
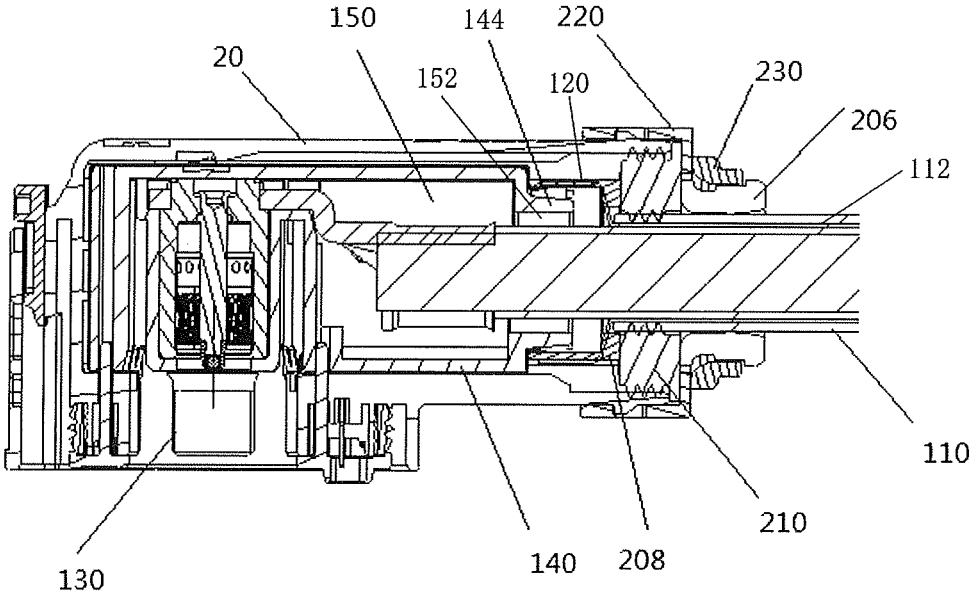
FIG. 11 is a structural sectional diagram of a connector assembly in the invention.

As shown in FIGS. 2 and 11, a connector assembly 1 is provided and comprises a terminal assembly with a cable and a connector housing 20. With reference to FIGS. 2 and 3, the connector housing 20 is provided with a first receiving cavity 200, and the terminal assembly with the cable is arranged and fixed in the first receiving cavity 200 of the connector housing 20.

As shown in FIGS. 2-5, the terminal assembly with the cable comprises the terminal assembly and the cable 110. The terminal assembly comprises a connecting terminal 130, a shielding shell 140, and an insulator 150 arranged between the connecting terminal 130 and the shielding shell 140. The shielding shell 140 is arranged around the connecting terminal 130 and is mutually insulated from the connecting terminal 130 by virtue of the insulator 150. The shielding shell 140 is provided with a second receiving cavity 142 and a second inserting hole 141. The second inserting hole 141 is communicated with the second receiving cavity 142. The insulator 150 is provided with a sleeve 152. The sleeve 152 is provided with a third inserting hole 151. After the insulator 150 is mounted in the second receiving cavity 142 of the shielding shell 140, the sleeve 152 on the insulator 150 extends out of the second receiving cavity 142 from the second inserting hole 141.

Figure 6:
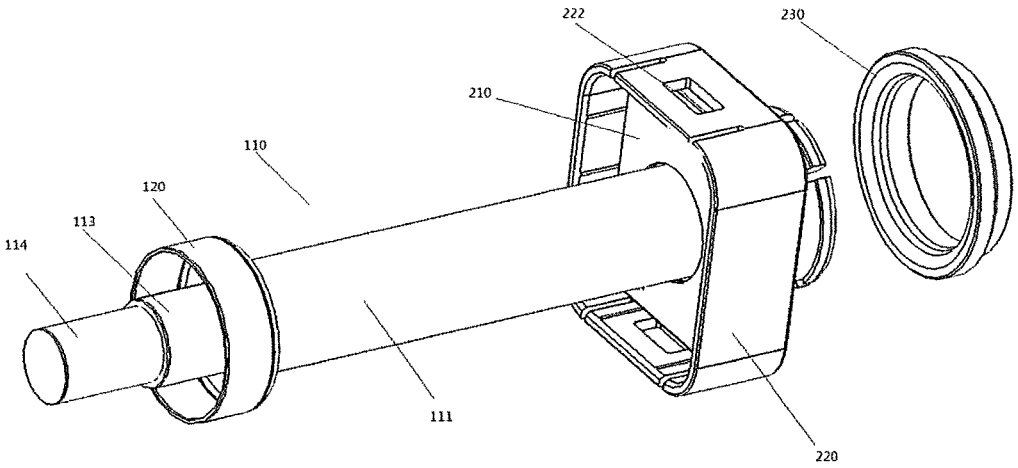
FIG. 6 is a structural schematic diagram showing a cable, a sealing element retainer and a hoop in the invention.

As shown in FIG. 6, the cable 110 is sequentially provided with a protective jacket 111, a shielding layer (not shown in the figure), an insulating layer 113 and a cable core 114 from outside to inside. The shielding layer can be a metal mesh or a metal tube depending on the requirements of specific use occasions. In a preferred example as shown in the figure, the shielding layer is provided with a shielding collar 120 at an end thereof. One end of the cable 110 is connected with the terminal assembly 100. Referring to FIG. 11, after one end of the cable 110 is led through the third insulating hole 151 of the insulator 150, the cable core 114 of the cable 110 is electrically connected with the connecting terminal 130; moreover, the shielding layer of the cable 110 is electrically connected with the shielding shell 140 in the terminal assembly 100. In a preferred example as shown in the figure, the shielding layer is electrically connected with the shielding shell 140 through the shielding collar.

Figure 4:
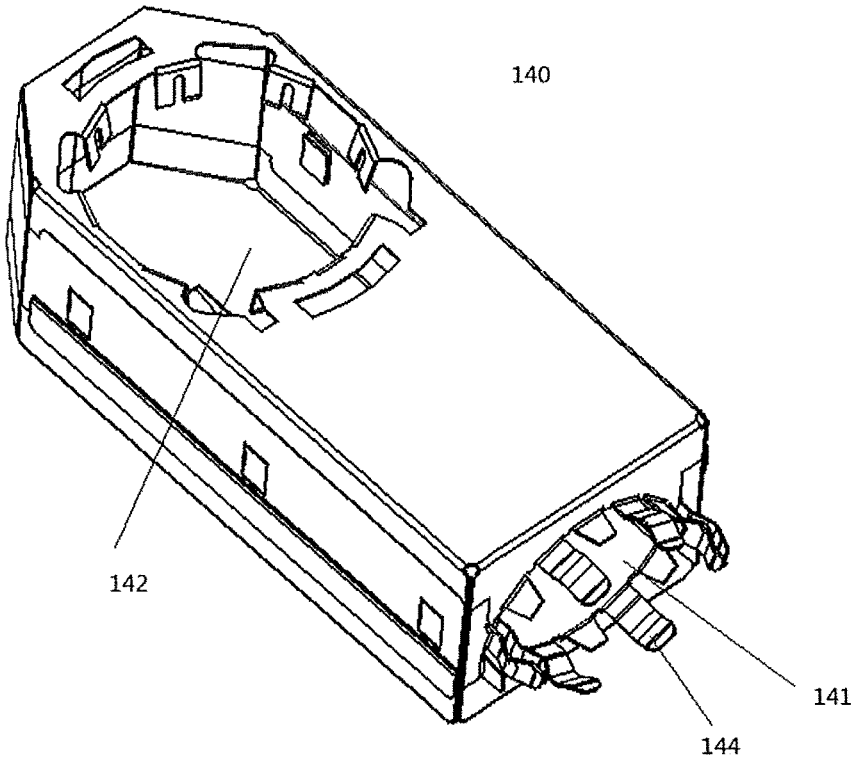
FIG. 4 is a structural schematic diagram showing a shielding shell in the invention.
Figure 5:
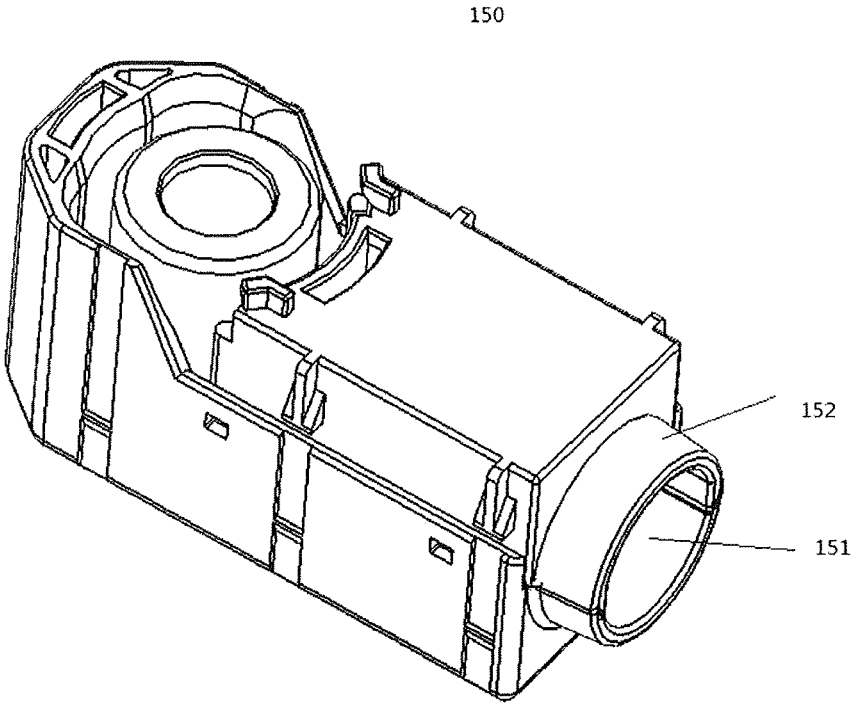
FIG. 5 is a structural schematic diagram showing an insulator in the invention.
Figure 9A:
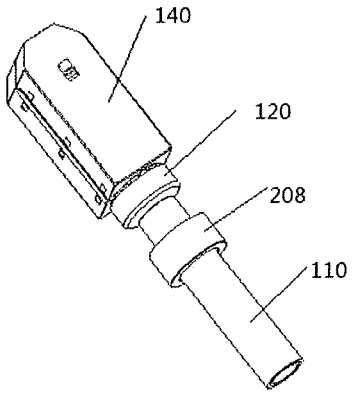
FIG. 9A is a structural schematic diagram showing the shielding shell and a shielding collar in the invention before they are connected.
Figure 9B:
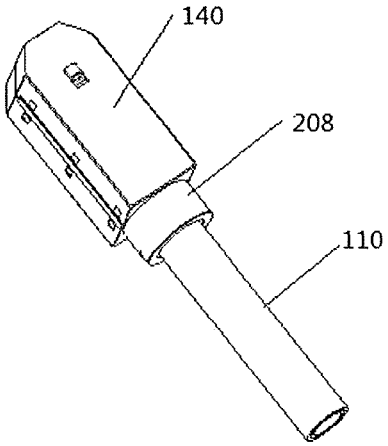
FIG. 9B is a structural schematic diagram showing the shielding shell and the shielding collar in the invention as shown in FIG. 9A after they are connected by a compress ring.

As shown in FIGS. 4 and 11, the shielding shell 140 in the terminal assembly 100 is provided with a shielding connecting part for connecting with the shielding layer 112 of the cable 110 to realize the electric connection of the shielding shell 140 in the terminal assembly with the shielding layer of the cable 110. In an example as shown in FIG. 4, the shielding connecting part comprises one or more elastic arms 144, and the plurality of elastic arms 144 can be arranged around the second inserting hole 141. The insulator 150 is arranged in the shielding shell 140. The sleeve 152 projects outwards from the second inserting hole 141. The plurality of elastic arms 144 are sleeved on the outer wall of the sleeve 152 in a surrounding manner and are inserted in the tubular cavity of the shielding collar 120 or arranged around the outer wall of the shielding collar 120, so as to form a mutual overlapping region between a portion of the shielding shell 140 and a portion of the shielding layer 112 of the cable along a radial direction of the cable (namely, viewing along the diameter of the cable). In the embodiment, preferably the plurality of elastic arms 144 are inserted in the tubular cavity of the shielding collar 120 and located between the shielding collar 120 and the sleeve 152. Due to tight connection between the shielding collar 120 and the sleeve 152, the shielding collar 120 can be put into contact with the elastic arms 144 at the overlapping region. In the embodiment, more preferably, a compress ring 208 is sleeved outside the shielding collar 120 as shown in FIGS. 9A and 9B; the compress ring 208 sleeved on the shielding collar 120 is used for compressing the shielding collar 120 and the elastic arms 144 into tight contact with each other, thereby enhancing the electric connection effect.

With reference to FIGS. 3 and 11, the connector housing 20 is provided with a first inserting hole 202, and the first inserting hole 202 is communicated with the first receiving cavity 200 of the connector housing 20. The terminal assembly of the terminal assembly with the cable is arranged in the first receiving cavity 200 and the cable 110 extends out of the housing 20 via the first inserting hole 202. The cable 110 is sealed with the connector housing 20 by use of the sealing element 210. For example, the sealing element 210 is sleeved outside the cable 110 and is arranged in the first inserting hole 202 of the connector housing 20.

Figure 10A:
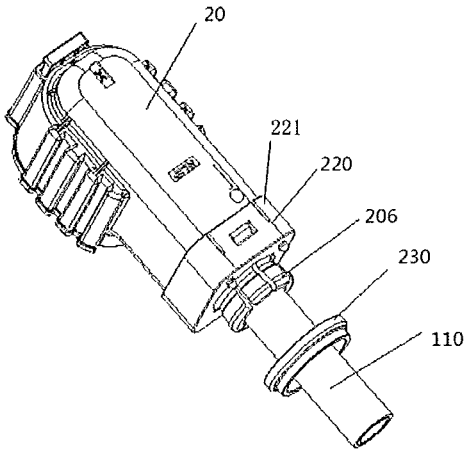
FIG. 10A is a structural schematic diagram showing the hoop and the sealing element retainer in the invention before they are connected.

The sealing element 210 is fixed in the connector assembly 1 by use of a retaining mechanism. In an example as shown in FIG. 10A, the retaining mechanism comprises a sealing ring retainer 220. One end 221 of the sealing ring retainer 220 is sleeved outside the end of the connector housing 20 and is fixed on the connector housing 20. For example, the connector housing 20 is provided with a plurality of snap clips 206 projecting from the outer wall 204 of the housing. The number of the snap clips 206 depends on specific use requirements. The plurality of snap clips 206 are arranged around the first inserting hole 202 and used for matching the corresponding snap grooves 222 formed in one end of the sealing ring retainer 220 so as to detachably retain the sealing element 210 on the connector housing 20.

Figure 7:
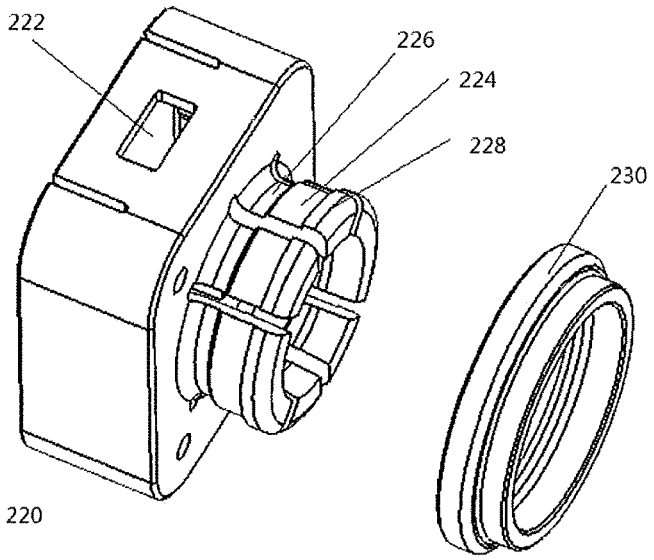
FIG. 7 is a structural schematic diagram showing the sealing element retainer and the hoop in the invention as observed from another perspective.
Figure 8:
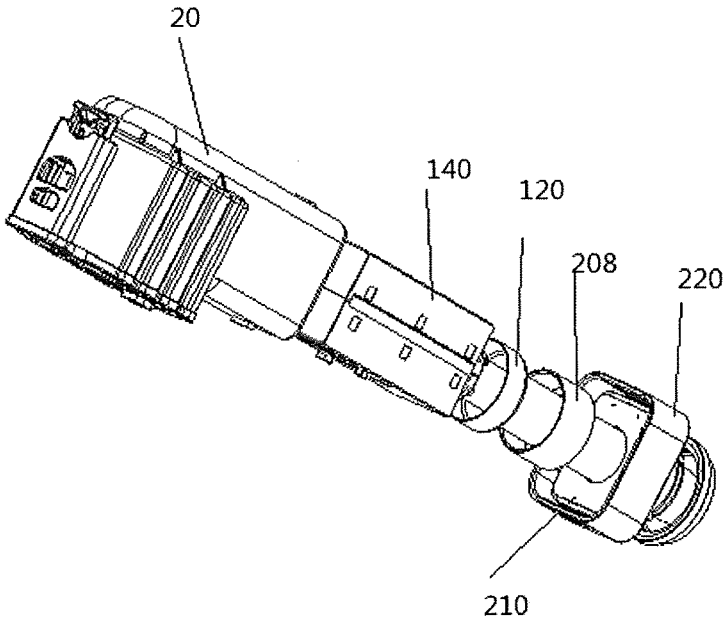
FIG. 8 is a structural schematic diagram showing a terminal assembly in the invention.
Figure 10B:
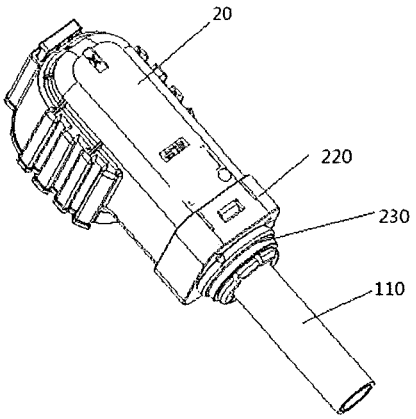
FIG. 10B is a structural schematic diagram showing the hoop and the sealing element retainer in the invention after they are connected.

The retaining mechanism may further comprise a hoop 230. As shown in FIGS. 10A and 10B, the hoop 230 is sleeved on the other end of the sealing ring retainer 220 to fix the sealing ring retainer 220 on the cable 110. In an example as shown in FIG. 7, the other end of the sealing ring retainer 220 is of a splitted structure to form a plurality of elastic pieces 224 that are spaced from each other. The hoop 230 is sleeved on the plurality of elastic pieces 224 and is in tight fit with the plurality of elastic pieces 224. When the hoop 230 is sleeved on the plurality of elastic pieces 224, the cable 110 is clamped by the plurality of elastic pieces 224 so that the sealing ring retainer 220 is mutually connected with the cable 110, and therefore, the sealing element 210 is retained and fixed in the connector assembly 1.

With reference to FIGS. 7, 10A and 11, in order to enhance the safety and stability of the hoop 230 on the plurality of elastic pieces 224, a groove 226 can be formed on each elastic piece 224 in the invention; the grooves 226 of the plurality of elastic pieces 224 continuously form a circle of grooves; or a flange 228 can be formed at an end of each elastic piece 224 and the flange 228 projects from the outer wall of the elastic piece 224; or both the grooves 226 and the flanges 228 can be formed. In an example as shown in the figures, the grooves 226 and the flanges 228 are formed on the outer walls of the plurality of elastic pieces 224. The hoop 230 is located in the grooves 226 when sleeved on the plurality of elastic pieces 224.

The elastic pieces 224 in the invention may also be replaced with a sleeve; the sleeve is provided with gaps at one end thereof extending in the axial direction so that the one end of the sleeve is formed into a plurality of elastic pieces. Grooves and flanges are formed on the outer wall of the sleeve. The hoop is sleeved on the outer wall of the sleeve. The metal collar, the shielding sleeve and the elastic arms are compressed into tight contact with one another by virtue of the pressure applied by the hoop to the sleeve.

The housing 20 in the invention is the connector housing. Other parts than the cable can be collectively referred to as a connector.

According to the terminal assembly with the cable and the connector assembly in the invention, the shielding layer of the cable can be put into contact connection with the elastic arms of the shielding shell in the terminal assembly by pushing the shielding collar, thereby realizing the shielded connection between the shielding shell in the terminal assembly and the shielding layer of the cable. Such a connection way of the elastic arms of the shielding shell of the terminal assembly and the shielding layer of the cable does not require crimping, and therefore, the assembling difficulty is reduced and small force is required. No special tool is needed for mounting the shielding collar and the hoop to realize easy and convenient assemblies. In the present invention, the shielding collar is utilized instead of the shielding sleeve and the shielding bushing, and therefore, the connector is simpler in structure, and furthermore, the production cost is reduced and the structure is more compact so that the size of the connector in the axial direction of the cable can be effectively reduced. As the clamping grooves or the flanges are formed on the sealing ring retainer, the sealing ring retainer can be tightly sleeved on the cable firmly by use of the hoop so that the sealing element is retained in the housing, and the cable and the shell are fixed together to achieve higher safety and reliability in use. Furthermore, the terminal assembly with the cable of the invention thus is applicable to automobiles as a high-voltage connector. The terminal assembly with the cable is capable of effectively resisting shock and preventing mechanical vibration from causing separation of the connector to affect safe use when it is used in the automobile.

The embodiments of the present invention are merely used for describing the present invention rather than limiting the scope of the claims. Other substantially equivalent substitutions that occur to those skilled in the art shall fall into the protection scope of the present invention.

What is claimed is:

1. A terminal assembly with a cable, comprising:

a terminal assembly including a connecting terminal, a shielding shell and an insulator arranged between the connecting terminal and the shielding shell; and a cable including a shielding layer;

wherein the shielding shell is formed with a receiving cavity and an inserting hole, the shielding shell receiving cavity communicating with the shielding shell inserting hole;

wherein a portion of the shielding shell of the terminal assembly and a portion of the shielding layer of the cable form a mutual overlapping region along a radial direction of the cable, the portion of the shielding shell comprises a shielding connecting part arranged around the shielding shell inserting hole, the shielding connecting part comprises a plurality of elastic arms arranged around the shielding shell inserting hole; and wherein, in the mutual overlapping region, the shielding layer is electrically connected with the shielding shell.

2. The terminal assembly with the cable of claim 1, wherein the insulator is provided with a sleeve having a sleeve inserting hole; and wherein after the insulator is mounted in the shielding shell receiving cavity of the shielding shell, the sleeve on the insulator projects out of the shielding shell receiving cavity from the shielding shell inserting hole.

3. The terminal assembly with the cable of claim 1, wherein the shielding layer comprises a shielding collar, the shielding connecting part being sleeved on an outer surface of the sleeve, the shielding collar surrounding the shielding connecting part and being sleeved outside the shielding connecting part; and wherein the shielding connecting part is located between the sleeve and the shielding collar, the shielding collar being in contact with the shielding connecting part.

4. The terminal assembly with the cable of claim 3, wherein the plurality of elastic arms being located between the sleeve and the shielding collar.

5. The terminal assembly with the cable of claim 1, further comprising a compression ring, wherein the portion of the shielding layer surrounds the shielding connecting part; and wherein the portion of the shielding layer of the cable is located between the plurality of elastic arms and the compression ring along the radial direction of the cable.

6. The terminal assembly with the cable of claim 1, further comprising a compression ring, wherein the compression ring is sleeved over the overlapping region so that the portion of the shielding shell and the portion of the shielding layer are kept in contact with each other in an overlapping region to realize the electric connection of the shielding shell with the shielding layer.

7. A connector assembly, comprising a connector housing and the terminal assembly with the cable of any one of claims 1, 2 and 3-6, wherein the connector housing is formed with a receiving cavity and a inserting hole, the connector housing inserting hole being communicated with the connector housing receiving cavity; and wherein the terminal assembly is arranged in the connector housing receiving cavity while the cable is led out of the connector housing via the connector housing inserting hole.

8. The connector assembly of claim 7, further comprising a sealing element sleeved outside the cable and arranged in the inserting hole of the connector housing or at an end of the connector housing to seal the terminal assembly in the connector housing receiving cavity.

9. The connector assembly of claim 8, further comprising a retaining mechanism for fixing the sealing element at an end of the connector housing or in the connector housing inserting hole.

10. The connector assembly of claim 8, further comprising a sealing ring retainer, wherein one end of the sealing ring retainer is sleeved on an end of the connector housing and is detachably fixed to the connector housing.

11. The connector assembly of claim 10, further comprising a hoop sleeved on the other end of the sealing ring retainer to fix the sealing ring retainer on the cable.

12. The connector assembly of claim 11, wherein the other end of the sealing ring retainer is of a split structure to form a plurality of elastic pieces that are spaced from one another; and wherein the hoop is sleeved on the plurality of elastic pieces and is in tight fit with the plurality of elastic pieces to deform the elastic pieces to produce elastic force.

13. The connector assembly of claim 12, wherein each of the elastic pieces is formed with a length of groove, the grooves on the plurality of elastic pieces being continuously arranged to form a circle of grooves; and wherein the hoop is located in the grooves.

14. The connector assembly of claim 12, wherein a flange is formed at an end of each elastic piece, the flanges projecting from outer walls of the elastic pieces to prevent the hoop from falling off from the elastic pieces.

* * * * *